US011465154B2

(12) United States Patent
Heath et al.

(10) Patent No.: US 11,465,154 B2
(45) Date of Patent: Oct. 11, 2022

(54) GRINDING MILLS

(71) Applicants: OUTOTEC (FINLAND) OY, Espoo (FI); SWISS TOWER MILLS MINERALS AG, Baden (CH)

(72) Inventors: Alex Heath, Melville (AU); Jeffrey Victor Belke, Mt Pleasant (AU); Edward Allan Jamieson, Bayswater (AU)

(73) Assignees: OUTOTEC (FINLAND) OY, Espoo (FI); SWISS TOWER MILLS MINERALS AG, Baden (CH)

( * ) Notice: Subject to any disclaimer, the term of this patent is extended or adjusted under 35 U.S.C. 154(b) by 189 days.

(21) Appl. No.: 15/746,500

(22) PCT Filed: Jul. 27, 2016

(86) PCT No.: PCT/FI2016/050545
§ 371 (c)(1),
(2) Date: Jan. 22, 2018

(87) PCT Pub. No.: WO2017/017315
PCT Pub. Date: Feb. 2, 2017

(65) Prior Publication Data

US 2018/0207644 A1 Jul. 26, 2018

(30) Foreign Application Priority Data

Jul. 28, 2015 (AU) ..... 2015903008

(51) Int. Cl.
*B02C 17/16* (2006.01)

(52) U.S. Cl.
CPC ..... *B02C 17/163* (2013.01); *B02C 17/16* (2013.01)

(58) Field of Classification Search
CPC ..... B02C 17/163; B02C 17/16; B02C 17/10
(Continued)

(56) References Cited

U.S. PATENT DOCUMENTS 3,233,835 A * 2/1966 Sevin ..... B01F 9/18 241/72
3,307,792 A * 3/1967 Haigh ..... B02C 17/16 241/98

(Continued)

FOREIGN PATENT DOCUMENTS

AU 2014210606 A1 4/2015
CN 2367428 Y 3/2000

(Continued)

OTHER PUBLICATIONS

English translate (JP2001046899A), retrieved date Jun. 4, 2020.*

(Continued)

*Primary Examiner* — Jessica Cahill
*Assistant Examiner* — Mohammed S. Alawadi
(74) *Attorney, Agent, or Firm* — Robert P. Michal, Esq.; Carter, DeLuca & Farrell LLP

(57) ABSTRACT

A stirring device for stirring a particulate material and a grinding media in a grinding mill includes one or more protective elements that extend outwardly from a body to deflect the particulate material and the grinding media from the body to minimize contact of the mixture of the particulate material and the grinding media against the body and to promote contact between the particulate material and the grinding media.

18 Claims, 15 Drawing Sheets

(58) Field of Classification Search
USPC ..... 241/22
See application file for complete search history.

(56) References Cited

U.S. PATENT DOCUMENTS

| | | | | | |
|---|---|---|---|---|---|
| 3,533,566 | A | | 10/1970 | Macquat | |
| 3,550,915 | A | | 12/1970 | Kaspar et al. | |
| 4,117,981 | A | | 10/1978 | Engels | |
| 4,174,074 | A | * | 11/1979 | Geiger | B02C 17/16 241/172 |
| 4,382,557 | A | * | 5/1983 | Duerr | B02C 17/16 241/1 |
| 5,312,055 | A | * | 5/1994 | Barthelmess | B02C 17/16 241/172 |
| 6,158,680 | A | * | 12/2000 | Ranne | B02C 17/16 241/171 |
| 8,733,677 | B1 | * | 5/2014 | Villardi | B02C 17/181 241/171 |
| 2004/0021021 | A1 | * | 2/2004 | Ishikawa | B02C 17/16 241/172 |
| 2010/0170972 | A1 | | 7/2010 | Igarashi | |
| 2013/0233953 | A1 | | 9/2013 | Enderle | |

FOREIGN PATENT DOCUMENTS

| | | | | | |
|---|---|---|---|---|---|
| CN | 201267772 | Y | | 7/2009 | |
| CN | 201783352 | U | | 4/2011 | |
| CN | 201841032 | U | | 5/2011 | |
| CN | 202497916 | U | | 10/2012 | |
| CN | 203304006 | U | | 11/2013 | |
| CN | 203355806 | U | | 12/2013 | |
| CN | 203816714 | U | | 9/2014 | |
| DE | 202008006745 | U1 | | 7/2008 | |
| DE | 202014102338 | U1 | | 6/2014 | |
| GB | 1000040 | A | | 8/1965 | |
| JP | 2001046899 | | * | 2/2001 | B02C 17/16 |
| JP | 2001046899 | A | | 2/2001 | |
| JP | 3945717 | B1 | | 7/2007 | |
| WO | 0018510 | A1 | | 4/2000 | |
| WO | 2013167851 | A1 | | 11/2013 | |

OTHER PUBLICATIONS

Crystal Definition, Examples, and Common Types, retrieved date Dec. 31, 2020.*
Diamond density, retrieved date Dec. 31, 2020.*
Sand density, retrieved date Jan. 1, 2021.*
Vermeer_s Palette_The Anatomy of Pigment and Binder, retrieved date May 10, 2021.*
Volume, Weight, and Pigment to Oil Ratios, retrieved date 010/May 2021.*
International Search Report issued by the Finnish Patent and Registration Office acting as the International Searching Authority in relation to International Application No. PCT/FI2016/050545 dated Nov. 4, 2016 (8 pages).
Written Opinion of the International Searching Authority issued by the Finnish Patent and Registration Office acting as the International Searching Authority in relation to International Application No. PCT/FI2016/050545 date of completion Nov. 2, 2016 (12 pages).
International Preliminary Report on Patentability issued by the Finnish Patent and Registration Office acting as the International Searching Authority in relation to International Application No. PCT/FI2016/050545 date of completion Nov. 20, 2076 (9 pages).
Notification of the First Office Action issued by the State Intellectual Property Office of The People's Republic of China in relation to Chinese Application No. 201680046776.4 dated Feb. 1, 2019 (11 pages) along with English Tanguage translation (10 pages).
Extended European Search Report issued by the European Patent Office in relation to European Application No. 16829910.5 dated Feb. 1, 2019 (9 pages).
Communication Pursuant to Article 94(3) EPC issued by the European Patent Office in relation to European U.S. Appl. No. 16/829,910, filed May 14, 2020, 8 pages.
Rejection Decision issued by the China National Intellecutal Property Adminislialion (8 pages), in corresponding Chinese Appln. No. 201680046776.4, dated Apr. 1, 2021 with English translation (6 pages), total of 14 pages.

* cited by examiner

GRINDING MILLS

CROSS-REFERENCE TO RELATED APPLICATIONS

This application is a National Phase Entry under 35 USC § 371 of PCT Patent Application Serial No. PCT/F12016/050545 filed Jul. 27, 2016, which claims priority to Australian Patent Application No. 2015903008 filed Jul. 28, 2015, the disclosure of each of these applications is expressly incorporated herein by reference in their entirety.

FIELD OF THE INVENTION

The invention relates to improvements in grinding mills and in particular to a stirring device for a grinding mill, stirring device assembly, mill body, grinding mill and method for grinding particulate material. The invention has been developed primarily for use in a fine grinding mill for grinding mineral ore particles. However, it will be appreciated that the invention is applicable in the grinding of other particulate material, such as concrete, cement, recyclable materials (such as glass, ceramics, electronics and metals), food, paint pigments, abrasives and pharmaceutical substances.

BACKGROUND OF THE INVENTION

Grinding mills are typically used in mineral processing to grind mineral ore particles into smaller sized particles to facilitate further downstream processing, such as separation of the valuable mineral particles from unwanted gangue. One type of grinding mill is a fine grinding mill for grinding mineral ore particles in the range of about 30 μm to 4000 μm in diameter down to particles of 5 to 40 μm in diameter. As fine grinding mills consume a large amount of power per tonne of ore processed, they are typically used on a concentrate stream comprising mostly of a high-grade mineral ore that has already been ground using a ball or SAG type grinding mill that performs coarse grinding as it is more economic.

The fine grinding mill has a stationary mill body or shell arranged vertically in the mill and an internal drive shaft. The drive shaft has a plurality of stirring elements, such as grinding discs, so that rotation of the drive shaft also rotates the stirring elements, which in turn rotates or stirs the mineral ore particles, usually in the form of a feed slurry, with a suitable grinding media. The resulting stirring action causes the mineral ore particles to be ground into smaller sized particles. However, the grinding discs tend to suffer from excessive wear, especially when the grinding mill is operated at high speeds through the action of the harder grinding media impacting against the grinding discs.

SUMMARY OF THE INVENTION

A first aspect of the present invention provides a stirring device for stirring a particulate material and a grinding media in a grinding mill, comprising one or more protective elements that extend outwardly from a body to deflect said particulate material and said grinding media from said body.

Preferably, said one or more protective elements comprise a deflection surface, said deflection surface being arranged at an angle to a direction of rotation of said body. More preferably, said deflection surface is at an angle in the range of 10° to 170°, preferably 20° to 160°, preferably 30° to 150°, preferably 40° to 130°, preferably 50° to 120°, preferably 60° to 110°, more preferably 70° to 100°, even more preferably 80° to 95°, and most preferably 85° to 90°. In one embodiment, said deflection surface is orthogonal to the direction of rotation of said body.

Preferably, said one or more protective elements extend at an angle to a surface of said body. More preferably, said angle is in the range of 10° to 170°, preferably 20° to 160°, preferably 30° to 150°, preferably 40° to 130°, preferably 50° to 120°, preferably 60° to 110°, more preferably 70° to 100°, even more preferably 80° to 95°, and most preferably 85° to 90°. In one embodiment, said one or more protective elements extend orthogonally from said surface. In some embodiments, said body surface is a planar surface. In other embodiments, said body surface is a non-planar surface.

Preferably, said body comprises an outer edge, wherein said one or more protective elements extend from said outer edge. More preferably, said one or more protective elements extend radially from said outer edge.

Preferably, said body comprises opposed surfaces and said one or more protective elements extend from at least one of said opposed surfaces. More preferably, said one of more protective elements extend from each of said opposed surfaces.

Preferably, there is a plurality of said protective elements, said protective elements being spaced apart around said body. More preferably, said protective elements are spaced apart at regular intervals. In one embodiment, said protective elements are spaced apart at irregular or uneven intervals. In a further embodiment, some of said protective elements are spaced apart at regular intervals on one portion of said body and other of said protective elements are spaced apart at irregular intervals on another portion of said body.

Preferably, said body comprises an annular shape. In one embodiment, said body comprises an annular disc. More preferably, said opposed surfaces are planar surfaces. In one embodiment, said outer edge is an outer circumferential edge of said annular disc. In some embodiments, said annular disc has a diameter in the range of 250 mm to 3000 mm, preferably 300 mm to 2750 mm and most preferably 400 mm to 2500 mm.

The one or more protective elements can be configured into different shapes. Preferably, said one of more protective elements each comprise at least one or more of a projection, an elongated body, a block-shaped element, a flange, a tooth, a planar element, a vane, a blade, a fin, a plate, a bar, a post, a rod, a channel-shaped element, a V-shaped element, a U-shaped element, a depression, a recess, a ramp-like element and a wedge-shaped element.

Preferably, said one or more protective elements are substantially linear in shape. Alternatively, one or more protective elements have a non-linear configuration. For example, the protective element(s) may be helical, spiral, sinuous or curved, in whole or part.

Where said one or more protective elements comprise said block-shaped element, said block-shaped element is preferably connected to said planar body so that opposed sides of said block-shaped element extend outwardly from said opposed surfaces of said planar body. In one embodiment, said block-shaped element comprises an outer end that extends radially outwardly from an outer edge of said planar body. In some embodiments, said block-shaped element is integrally forms with said planar body. In other embodiments, said block-shaped element is U-shaped for mounting to said planar body.

Preferably, where said one or more protective elements comprise said planar element, said planar element is inclined relative to the said planar body. In one embodiment, said planar element is inclined towards a direction of rotation of said stirring device. In another embodiment, said planar element is inclined away from a direction of rotation of said stirring device.

Preferably, said planar element comprises a vane, blade, planar tooth or plate.

Preferably, said one or more protective elements are integrally formed with said body.

A second aspect of the present invention provides the use of the stirring device of the first aspect of the invention in a stirring device assembly.

A third aspect of the present invention provides a stirring device assembly for stirring a particulate material and a grinding media in a grinding mill, comprising a plurality of stirring devices of the first aspect of the invention mounted to a drive shaft for rotating said stirring devices.

Preferably, said stirring devices are spaced apart along the length of said drive shaft.

Preferably, said drive shaft comprises one or more of protective elements extending radially from said drive shaft. More preferably, said protective elements have the same features as the preferred features of the one or more protective elements of the first aspect of the invention.

A fourth aspect of the present invention provides the use of the stirring device assembly of the third aspect of the invention as a mill impeller in a grinding mill.

A fifth aspect of the present invention provides a drive shaft assembly for stirring a particulate material and a grinding media in a grinding mill, comprising a drive shaft and a plurality of protective elements for deflecting said particulate material and said grinding media from said drive shaft.

Preferably, said protective elements are spaced apart along the length of said drive shaft.

Preferably, at least two of said protective elements extend from either side of said drive shaft. In one embodiment, said protective elements extend radially outwardly from said drive shaft. In some embodiments, said protective elements are arranged around the circumference of said drive shaft.

Preferably, said protective elements have the same features as the preferred features of the protective elements of the first aspect of the invention, where applicable. For example, the protective elements also preferably have a deflection surface as in the first aspect of the invention, but which is arranged at angle to the direction of rotation of the drive shaft and not a stirring device body. In this case, the preferred ranges of the angle are the same, including providing the deflection surface substantially orthogonal to the direction of rotation of the drive shaft. Likewise, the protective elements may also extend at an angle, but with respect to the direction of rotation of the drive shaft and not a stirring device body. In one particularly preferred embodiment, said protective elements have a planar or non-curved deflection surface.

A sixth aspect of the present invention provides the use of the drive shaft assembly of the fourth aspect of the invention as a mill impeller in a grinding mill.

A seventh aspect of the present invention provides a mill body comprising the stirring device assembly of the third aspect of the invention or the drive shaft assembly of the fourth aspect of the invention.

Preferably, said mill body further comprises an inlet for receiving a particulate material and an outlet for discharging ground particles.

Preferably, said mill body comprises one or more shelves extending from an inner sidewall, said one or more shelves define one or more chambers containing said stirring devices or said protective elements, and openings communicating between said chambers.

Preferably, said one or more shelves alternate between said one or more stirring devices or said protective elements.

Preferably, said mill body is arranged vertically in said mill. In some embodiments, said mill body is arranged at an angle in said mill. In other embodiments, said mill body is arranged horizontally in said mill.

Preferably, said inlet is at the bottom of said mill body and said inlet is at the top of said mill body.

An eighth aspect of the present invention provides a grinding mill comprising the mill body of the seventh aspect of the invention.

Preferably, said grinding mill is a fine grinding mill. More preferably, said fine grinding mill has a power consumption of 10 to 70 kilowatt hours per tonne (kWhr/t). In one preferred embodiment, said fine grinding mill has a power consumption of 30 kWhr/t.

A ninth aspect of the present invention provides a mill body for grinding a particulate material comprising an inlet for receiving said particulate material, an outlet for discharging ground particles and a shelf extending from an inner sidewall, said shelf comprising one or more protective elements that extend outwardly from said shelf to deflect said particulate material and said grinding media said shelf.

Preferably, said one or more protective elements extend radially from said shelf.

Preferably, said shelf comprises opposed surfaces and said one or more protective elements extend from at least one of said opposed surfaces. More preferably, said one of more protective elements extend from each of said opposed surfaces.

Preferably, said one or more protective elements extend orthogonally from at least one of said opposed surfaces. More preferably, said one or more protective elements extend orthogonally from each of said opposed surfaces.

Preferably, there is a plurality of said protective elements, said protective elements being spaced apart around said shelf. In one embodiment, said protective elements are spaced apart at regular intervals. In another embodiment, said protective elements are spaced apart at uneven or regular intervals.

Preferably, said one or more protective elements of the sixth aspect have the same features as the preferred features of the one or more protective elements of the first aspect of the present invention, where applicable.

Preferably, said shelf is annular in shape. In some embodiments, said shelf is angled relative to the inner sidewall. In other embodiments, said shelf is a static counter disc.

A tenth aspect of present invention provides a grinding mill comprising the mill body of the ninth aspect of the invention, a drive shaft and a plurality of stirring elements mounted to said drive shaft.

Preferably, the grinding mill of the ninth aspect has the preferred features of the eighth aspect of the invention, where applicable.

An eleventh aspect of the present invention provides a method of grinding a particulate material in a grinding mill of the type having a mill body and a drive shaft for rotating a plurality of stirring devices within said mill body, said method comprising:

introducing grinding media into said mill body;

introducing said particulate material through an inlet; and operating said drive shaft to rotate said stirring devices within said mill body;

wherein said rotation of said stirring devices induces a rotating flow of said particulate material within said mill body to grind said particulate material against said grinding media to produce smaller sized particles; and wherein one or more protective elements deflect said particulate material and said grinding media away from said stirring devices.

Preferably, said method comprises creating a zone around said stirring devices where said grinding media is captured by said one or more protective elements and rotated with said stirring devices.

Preferably, said method comprises arranging said one or more protective elements at an angle to a direction of rotation of said stirring devices.

Preferably, said one or more protective elements comprise a deflection surface, said method comprising arranging said deflection surface at an angle to a direction of rotation of said stirring devices.

Preferably, said angle is in the range of 10° to 170°, preferably 20° to 160°, preferably 30° to 150°, preferably 40° to 130°, preferably 50° to 120°, preferably 60° to 110°, more preferably 70° to 100°, even more preferably 80° to 95°, and most preferably 85° to 90°. In one embodiment, said method comprising arranging said deflection surface orthogonally to the direction of rotation.

Preferably, said method comprises locating said one or more protective elements adjacent said stirring devices. In some embodiments, said one or more protective elements extend from said stirring devices. In other embodiments, said one or more protective elements extend from a shelf extending from an inner sidewall of said mill body.

A twelfth aspect of the present invention provides a method of grinding a particulate material in the grinding mill of the type having a mill body and a drive shaft assembly comprising a plurality of protective elements extending from a drive shaft, said method comprising:

introducing grinding media into said mill body;

introducing said particulate material through an inlet; and operating said drive shaft to rotate said drive shaft assembly within said mill body;

wherein said rotation of said drive shaft assembly induces a rotating flow of said particulate material within said mill body to grind said particulate material against said grinding media to produce smaller sized mineral particles; and wherein said protective elements deflect said particulate material and said grinding media away from said drive shaft.

Preferably, said particulate material comprises mineral particles. More preferably, said mineral particles have a F80 of 30 μm to 4000 μm, preferably 35 μm to 3000 μm, preferably 40 μm to 2000 μm, preferably 45 μm to 1500 μm, even more preferably 50 μm to 1000 μm, preferably 60 μm to 750 μm, further preferably 65 μm to 500 μm, further more preferably 70 μm to 400 μm, even more preferably 75 μm to 300 μm and most preferably 80 μm to 200 μm.

Preferably, wherein said smaller sized mineral particles have a P80 of 0.1 μm to 1000 μm, preferably 0.25 μm to 750 μm, preferably 0.3 μm to 500 μm, preferably 0.4 μm to 400 μm, preferably 0.5 μm to 300 μm, preferably 0.6 μm to 250 μm, preferably 0.7 μm to 200 μm further preferably 0.75 μm to 150 μm, further more preferably 0.8 μm to 100 μm, even more preferably 0.9 μm to 75 μm and most preferably 1 μm to 50 μm.

Preferably, wherein said particulate material comprises mineral particles. More preferably, said mineral particles are mineral ore particles having a density of at least 2,000 $kg/m^3$. In some embodiments, said mineral ore particles comprises at least one of iron, quartz, copper, nickel, zinc, lead, gold, silver, platinum, tungsten, chromium, silicon and combinations thereof.

Preferably, said particulate material comprises at least one of concrete, cement, recyclable material, pharmaceutical substances, paint pigment, abrasives and food. In some embodiments, said recyclable material comprises at least one of glass, ceramics, electronics and metals.

The methods of the tenth and eleventh aspects of the invention have the preferred features of any previous aspect of the invention, where applicable. In particular, said protective elements have the preferred features of the first aspect of the invention, where applicable.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
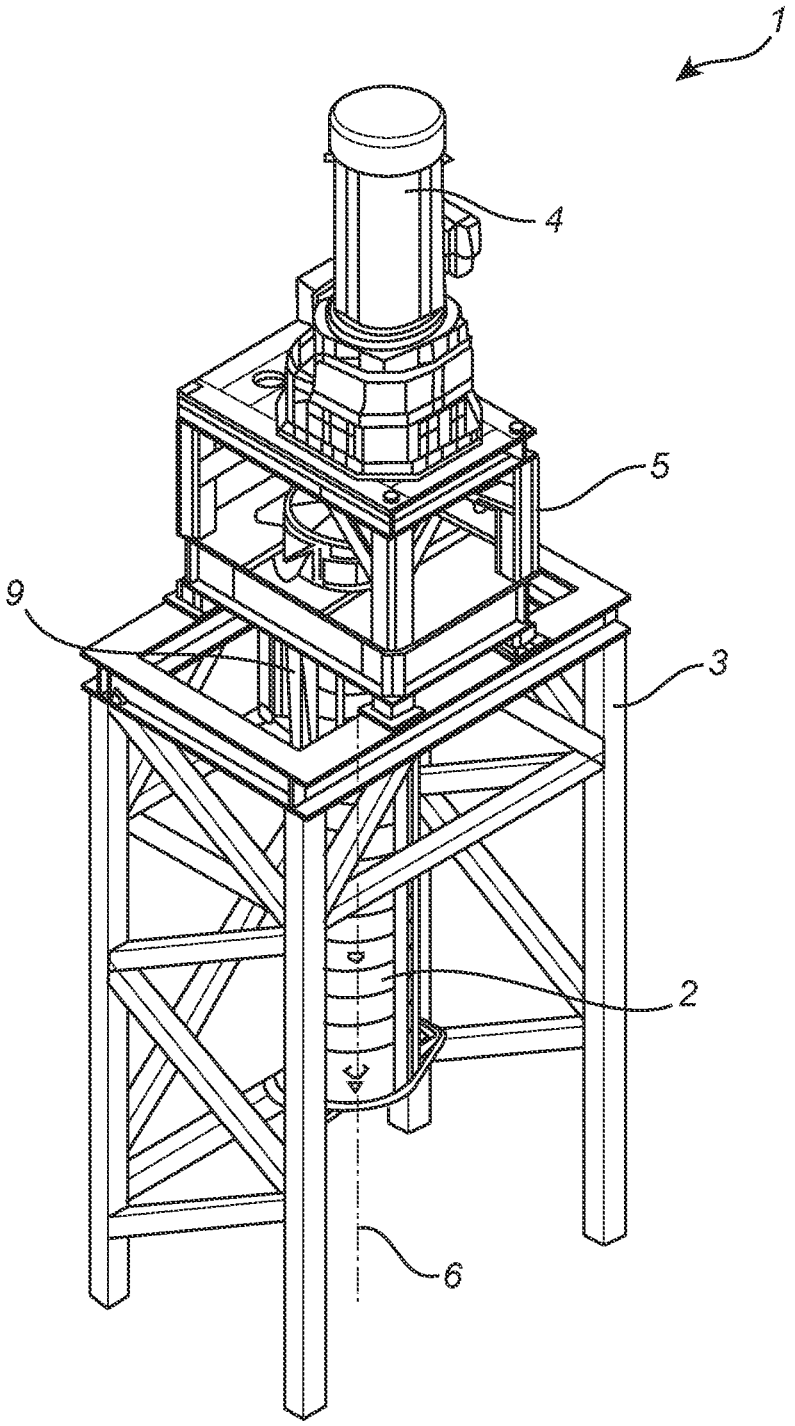
FIG. 1 is a perspective view of a grinding mill having a stirring device assembly comprising a plurality of stirring devices according to an embodiment of the invention.
Figure 2:
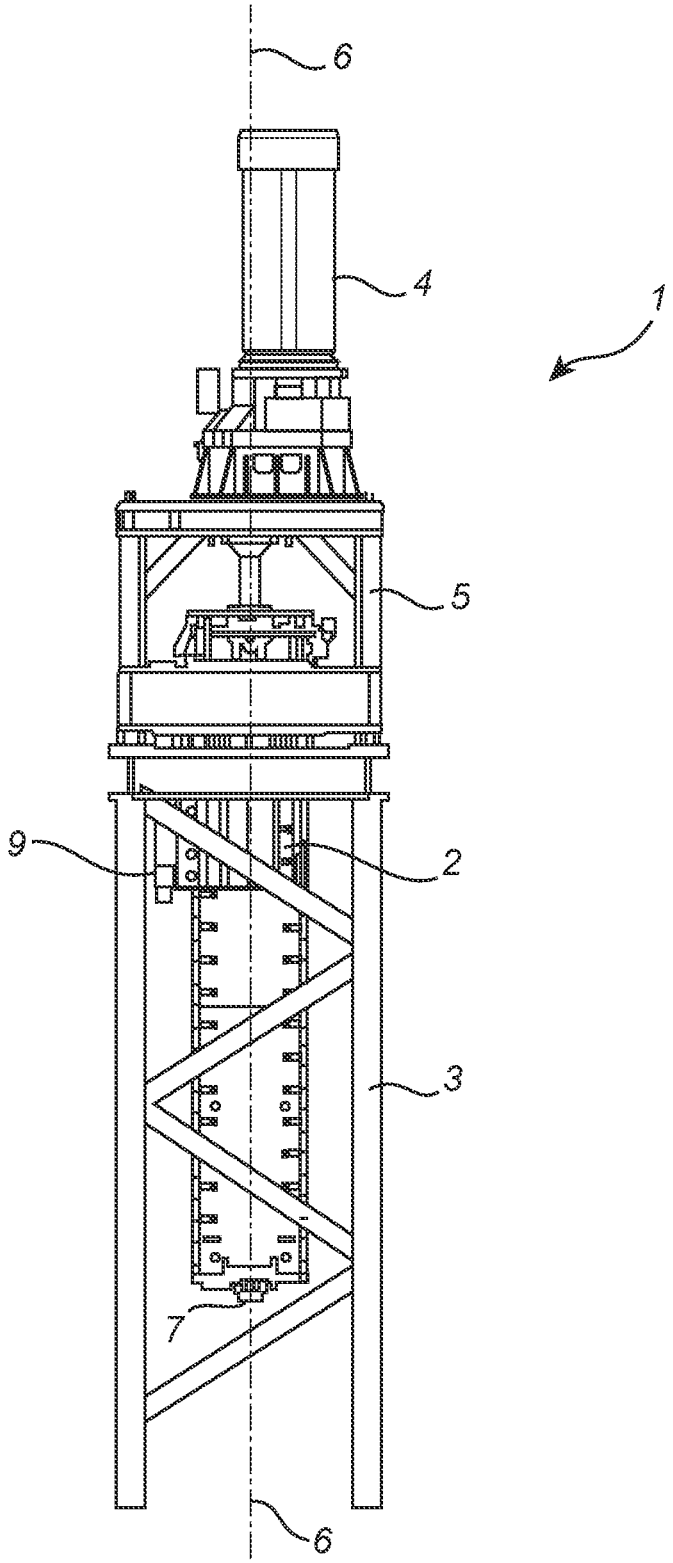
FIG. 2 is a front view of the grinding mill of FIG. 1.
Figure 3:
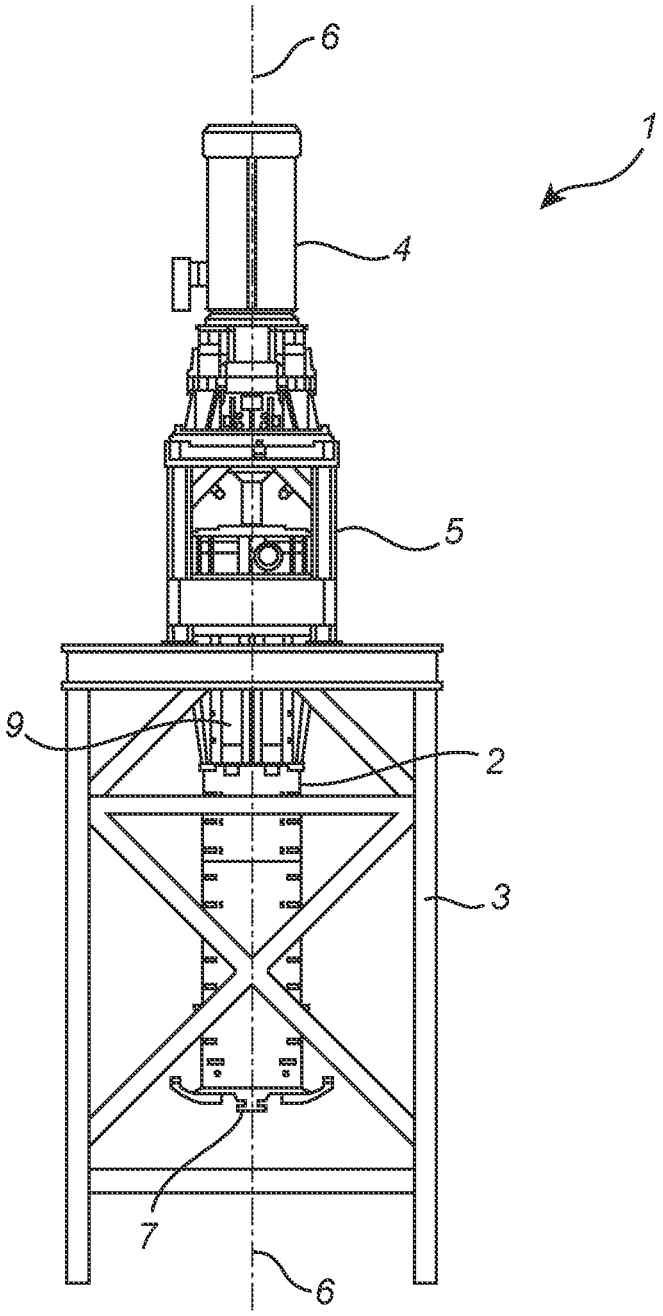
FIG. 3 is a side view of the grinding mill of FIG. 1.
Figure 4:
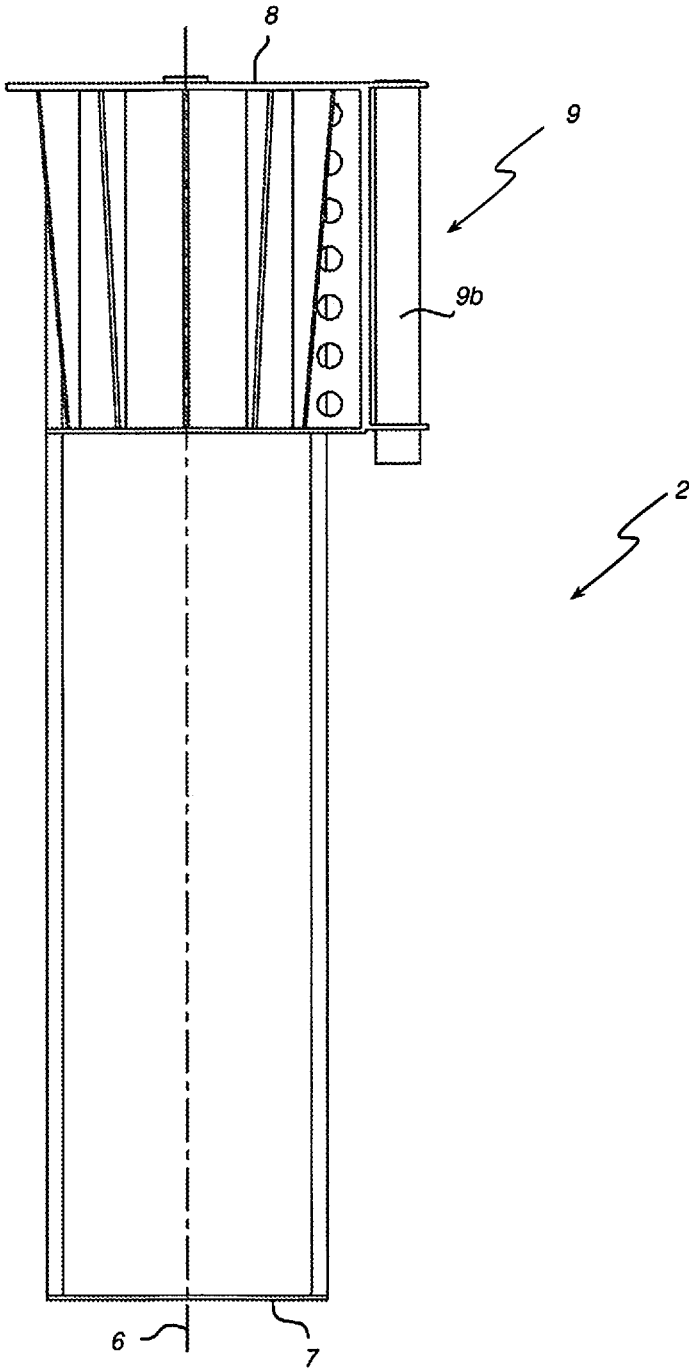
FIG. 4 is a rear view of the mill body used in the grinding mill of FIG. 1.
Figure 5:
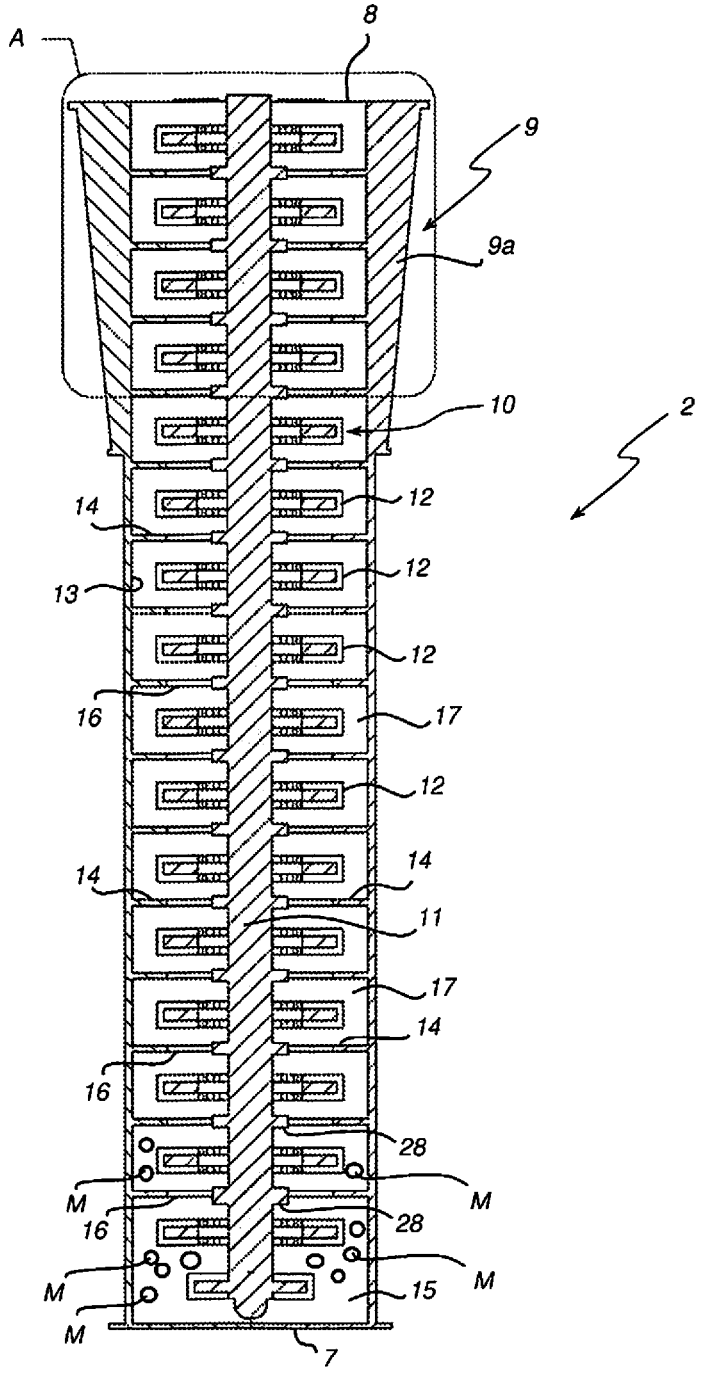
FIG. 5 is a cross-sectional view of the mill body of FIG. 4.
Figure 6:
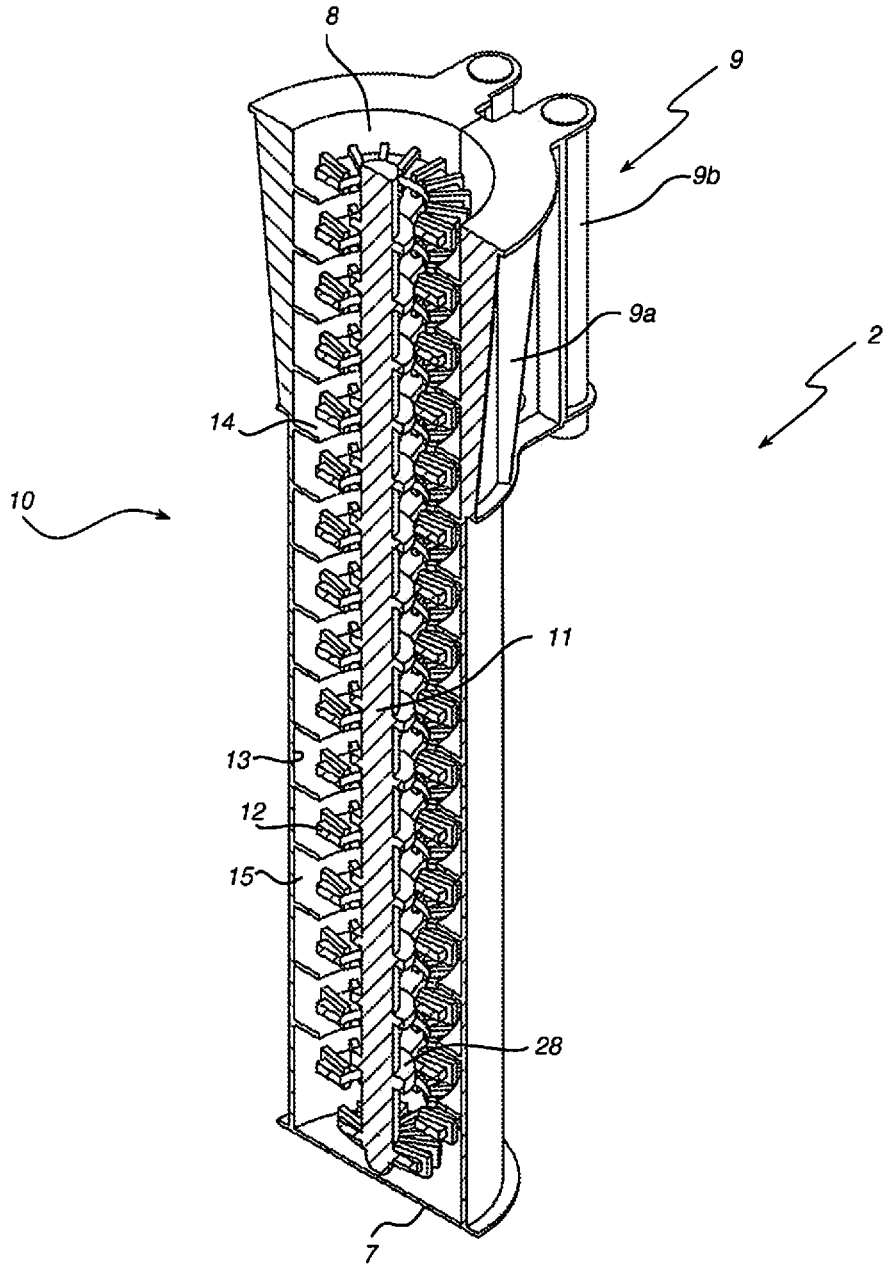
FIG. 6 is a partial cross-sectional perspective view of the mill body of FIG. 4.
Figure 7:
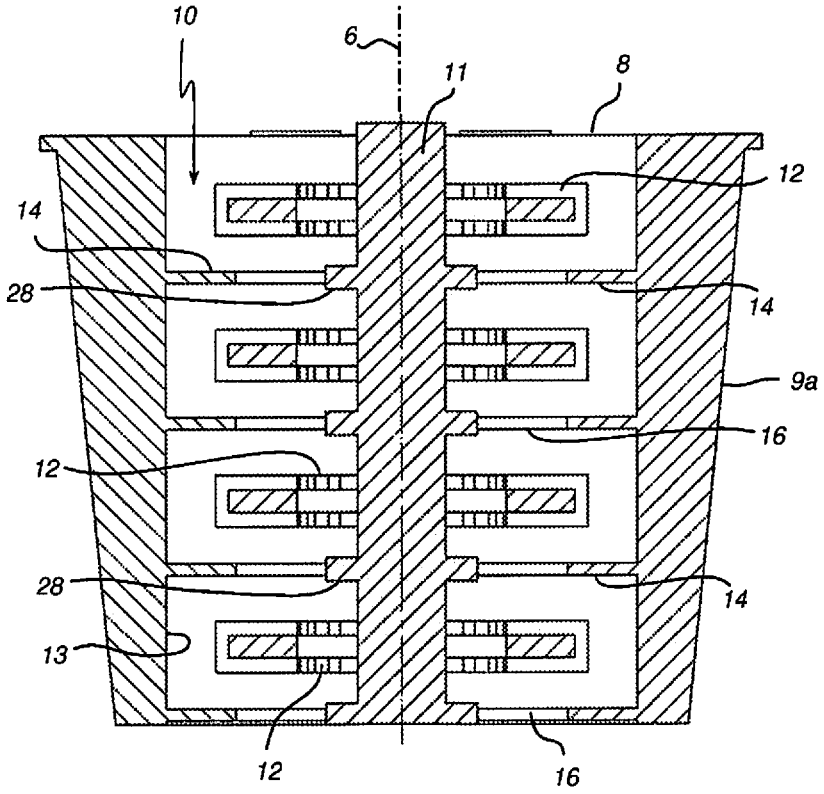
FIG. 7 is a partial cross-sectional view of the mill body of FIG. 4 at the mounting ring indicated by area A in FIG. 5.
Figure 8:
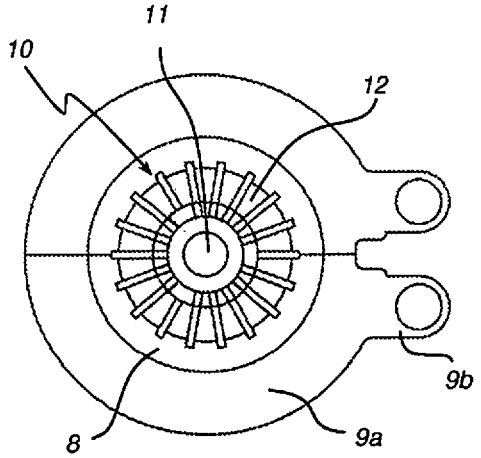
FIG. 8 is a top view of the mill body of FIG. 4.

The present invention will now be described with reference to the following examples which should be considered in all respects as illustrative and non-restrictive. In the Figures, corresponding features within the same embodiment or common to different embodiments have been given the same reference numerals. Referring to FIGS. 1 to 3, a grinding mill 1 for grinding a slurry having particulate material comprises a mill body 2 mounted on a base frame 3 and a drive mechanism 4 mounted on a drive frame 5 for rotating the mill body 3 about a longitudinal axis 6.

In this embodiment, the mill body 2 is arranged vertically in the grinding mill 1 and has a bottom inlet 7 and a top outlet 8. It will be appreciated that in other embodiments, the mill body 2 is arranged to be inclined or at an angle in the grinding mill 1. In some embodiments, the mill body 2 is arranged to lie horizontally in the grinding mill 1. Likewise, in other embodiments, the inlet 7*a* and outlet 8 can be placed at locations of the mill body 2 other than the bottom and top, respectively.

A charge of feed slurry comprising mineral ore particles is fed into the mill body 2 through the bottom inlet 7. Grinding media M is also added into the mill body 2 initially through the outlet 8 before the feed slurry is added and grinding mill 1 is in operation. Once the grinding mill 1 is in operation, the initial charge of grinding media M tends to wear out due to the grinding process. Accordingly, grinding media M is also progressively added with the feed slurry through the inlet 7 as the grinding mill 1 operates. The grinding media M typically comprises ceramic or steel beads that range from 1 mm to 5 mm in diameter. The size of the grinding media M may vary in other embodiments, depending on requirements. For example, the diameter of the grinding media can be 30 or 50 times the diameter of the slurry particles, which can be measured by reference to F80 or F100, which is discussed in more detail below. The mill body 2 is rotated by the drive mechanism 4 about the axis 6 to rotate or stir the feed slurry and grinding media together, causing the feed slurry particles to be crushed or ground against between the grinding media. The ground product is then discharged through the top outlet 8.

Referring to FIGS. 4 to 8, the mill body 2 comprises a mounting assembly 9 for fitting the mill body to the base frame 3 and operatively aligning the mill body to the drive mechanism 4. The mounting assembly 9 comprises a support gusset 9*a* and a mounting hinge 9*b*. The mill body 2 also comprises a stirring device assembly 10 comprising a drive shaft 11 to which are mounted a plurality of stirring devices 12 described in more detail below. In this embodiment, the stirring device assembly 10 takes the form of an impeller, but is also known as a drive shaft assembly. As such, the stirring device assembly will hereinafter be referred to as a mill impeller in reference to this embodiment.

An internal side wall 13 of the mill body 2 has a plurality of planar annular shelves 14 extending into the internal cavity 15 between the stirring devices 12 to sub-divide the mill body 2 so that the feed slurry flows upwardly from the bottom inlet 7 through openings 16 and eventually is discharged from the top outlet 8 after grinding. The shelves 14 tend to subdivide the internal cavity 15 into individual chambers 17. In this embodiment, the grinding mill 1 is a fine grinding mill, and is called a high intensity grinding mill, in which the rotating action of the stirring devices 12 results in intense grinding of the slurry particles by the grinding media M occurring in the cavity 15 adjacent the stirring devices. Fine grinding mills have a relatively high power consumption in order to achieve fine grinding, in the range from 10 kWhr/t to 70 kWhr/t (kilowatt hours per tonne). In this embodiment, the fine grinding mill has a power consumption of 30 kWhr/t.

Figure 9:
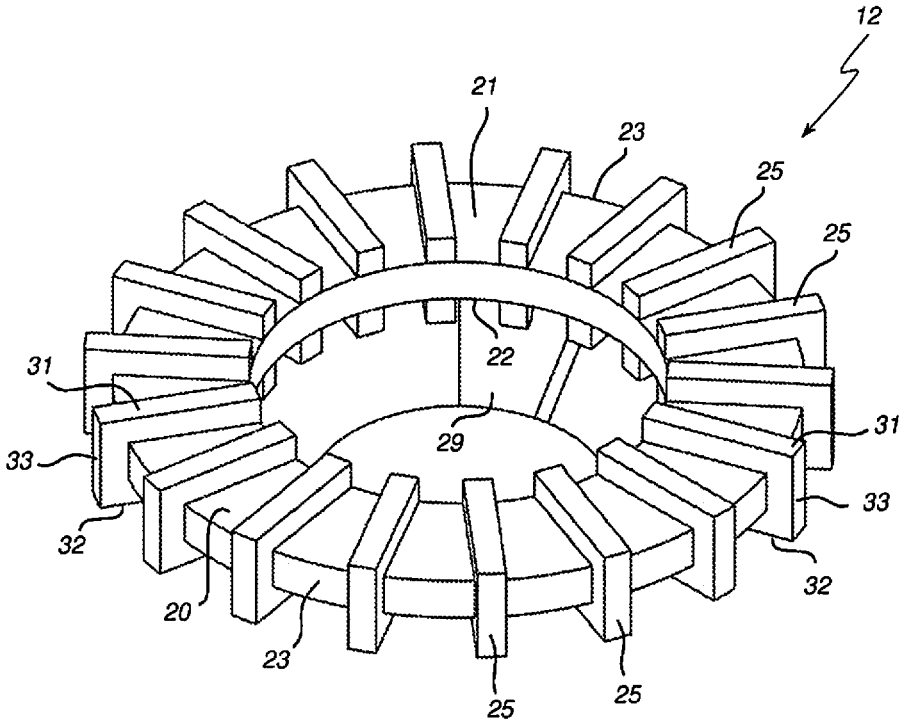
FIG. 9 is a perspective view of a stirring device in the stirring device assembly used in the mill body of FIG. 1.
Figure 10:
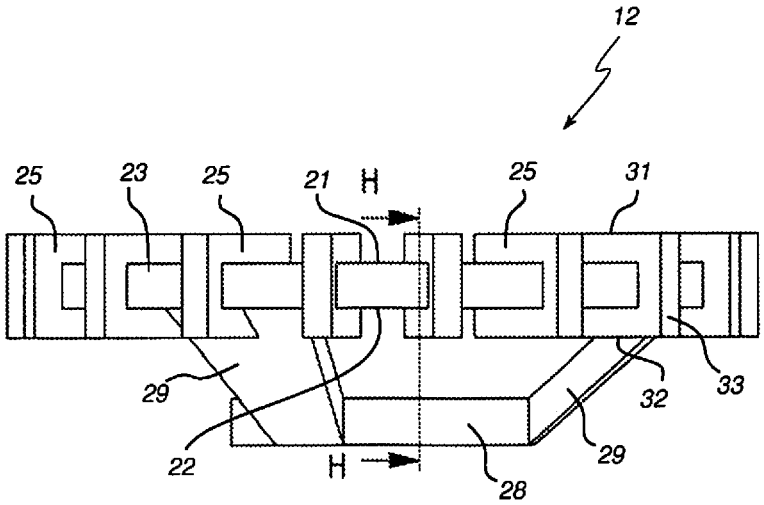
FIG. 10 is a side view of the stirring device of FIG. 9.
Figure 11:
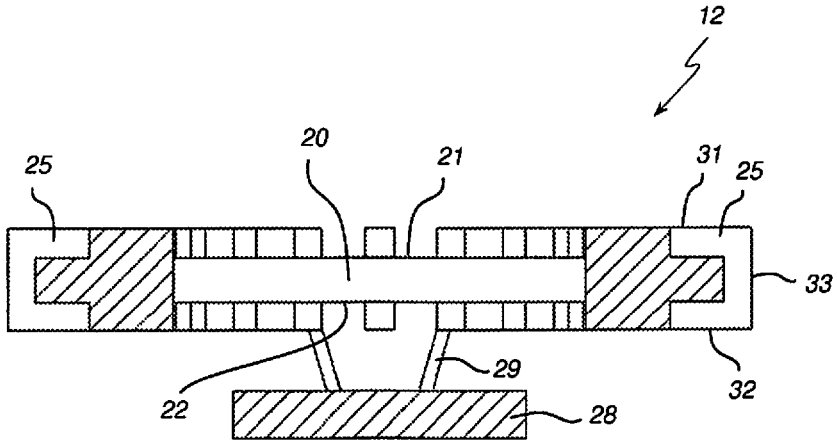
FIG. 11 is a cross-sectional view of the stirring device of FIG. 9.

Referring to FIGS. 9 to 11, the stirring devices 12 in the mill impeller 10 comprise a planar body 20 having opposed planar surfaces 21, 22 and an outer edge 23. In this embodiment, the planar body 20 is an annular disc but it will be appreciated that the planar body can take other forms in other embodiments, such as rectangular, square, oval or oval-like, circular and any other regular or irregular polygonal shape. It will be appreciated by one skilled in the art that for industrial duties the annular disc size ranges from 400 mm diameter to 2500 mm diameter. However, the invention applies equally to fine grinding discs of any size. Also, the stirring devices 12 can have surfaces other than two opposed surfaces, such as any number of surfaces that have the same or different shapes. For example, the stirring devices may have an inclined or angled surface, a curved surface, a corrugated surface, a saw-toothed surface, irregular surface or any other regular or irregular shape. For ease of reference, the stirring devices 12 and planar body 20 in this embodiment will hereinafter be referred to as grinding discs and disc body, respectively.

A plurality of protective elements 25 adjacent to the outer edge 23 extends outwardly from the disc body 20 to deflect the slurry particles and grinding media M. This effectively minimises or reduces the shear around the disc body 20 by minimising contact of the mixture of slurry particles and grinding media M against the disc body 20 and promoting contact between the slurry particles and grinding media. A mounting ring 28 is connected via arms 29 (typically known as spokes) to the disc body 20 for mounting each grinding disc 12 to the drive shaft 11 of the stirring device assembly 11. The protective elements 25 in this embodiment take the form of blocks or block-like elements that are integrally formed with the disc body 20 and arranged so that opposed sides 31, 32 and one end 33 of the blocks project outwardly from the planar surfaces 21, 22 and outer edge 23, respectively. Each block 25 thus extends both substantially orthogonally relative to the opposed planar surfaces 21, 22 via its opposed sides 31, 32 and radially outwardly from the outer edge 23 via its end 33. Alternatively, the protective elements 25 are in the form of U-shaped blocks mounted to the disc body 20 so that opposed sides 31, 32 and one end 33 of each block 25 extends or projects outwardly from the planar surfaces 21, 22 and outer edge 23 of the disc body, respectively.

In operation, the drive mechanism 4 rotates the drive shaft 11 of the stirring device assembly 10, rotating the grinding discs 12 that in turn rotate the feed slurry and grinding media within the internal cavity 15 of the mill body 2. This rotation causes the feed slurry particles to be ground against and between the harder grinding media, thus releasing valuable mineral particles and reducing them in size for further downstream processing after being discharged through the outlet 8. The feed slurry particles may also be ground against the mill impeller 10. This grinding action occurs over a period of time and thus can be viewed as attrition of the slurry particles. In addition, the blocks 25 act to create a zone (relative to the motion of the grinding disc 12) around the outer circumferential edges 23 and the opposed surfaces 21, 22 of the disc body 20, promoting contact between the feed slurry particles and the grinding media M. In effect, a rotating pocket of material comprising the feed slurry and grinding media M is formed and "captured" in the zone that can be transported by the blocks 25. At the same time, the zone created by the blocks 25 minimises the amount of shear or slippage at the surfaces 21, 22 of the grinding discs 12, thus reducing the amount of wear on the grinding discs 12. That is, the protective elements 25 tend to move the slurry and the grinding media M away from the grinding discs 12. This means that there is less chance of shear or slippage being concentrated at the grinding discs 12. In addition, there is a lower probability of impacts occurring between the grinding media M and the grinding discs 12, and any impacts that do occur are not substantial but only minor in nature. Hence, the grinding discs 12 do not suffer excessive wear during operation of the mill body 2 in the grinding mill 1.

It is known by those skilled in the art that concentrated mineral ore slurries frequently act as non-Newtonian (shear thinning) fluids with a yield stress. This means that such slurries tend to act as a solid body and do not act as a fluid until sufficient force is applied (exceeding the yield stress), after which the viscosity drops dramatically. As a consequence, in a conventional grinding mill of the type that uses a series of stirring elements like grinding discs, the highest shear force is applied by the rotational torque at the lowest radius from the rotational centre due to the geometry of the rotating discs and drive shaft. This results in the non-Newtonian slurry material yielding and becoming fluid immediately adjacent to the drive shaft and grinding discs, with the rest of the slurry material remaining stationary, or close to stationary. This results in the shear or "slip" being concentrated right at the surface of the grinding discs, accelerating the amount of wear to the grinding discs. Accelerated wear of the grinding discs makes their operational life very short, thus requiring more frequent replacement than desired. The frequent replacement of the grinding discs also increases the amount of downtime, reducing the efficiency of the grinding mill, as well as increasing maintenance costs.

From this description of conventional fine grinding mills using stirring elements, the technical advantages and benefits of the invention become apparent by way of contrast. In the embodiment of the invention, the zone around the outer edge 23 and the planar surfaces 21, 22 created by the blocks 25 alleviates or overcomes the above drawbacks and deficiencies that occur in conventional grinding mills. That is, the zone minimises or reduces the amount of wear on the grinding discs 12 by minimising the differential speed between the grinding media M and the grinding discs 12 (i.e. the amount of shear), prolonging their operational life. Consequently, there is less frequent replacement of the grinding discs 12, thus reducing maintenance costs and increasing grinding mill capacity due to there being less downtime for maintenance. By improving the amount or frequency of contact between the feed slurry particles and the grinding media M, the zone improves the efficiency of grinding in the grinding mill 1. Furthermore, the zone increases the amount of the feed slurry that acts as a fluid.

It will be appreciated that the protective elements 25 can take any number of forms in order to create the zone around each grinding disc 12. The protective elements 25 can be any form of projection that extends from the surfaces of the grinding disc 12, such as the upper planar surface 21, the lower planar surface 22, its outer edge 23 or any combination thereof. The protective element 25 can thus be planar, curved or adopt any polyhedral shape that protrudes for generating the zone. Some examples of possible shapes for the protective element 25 are illustrated in FIGS. 12A to 12G, 13A to 13E and discussed in more detail below. Aside from these specific examples, the protective elements 25 may comprise at least one or more of a protrusion, an elongated body, a flange, a tooth, a vane, a blade, a fin, a bar, a V-shaped element, a U-shaped element and a wedge-shaped element. However, it is preferred that the protective elements either extend or present a deflection surface that is at an angle so that they can gather or grip the slurry particles and grinding media M to deflect or move them away from the stirring device body. Hence, the most preferred implementation is to provide protective elements 25 that are orthogonal (i.e. 90°) to the direction of rotation of the stirring device 12 or slurry within the cavity 15.

Figure 12A:
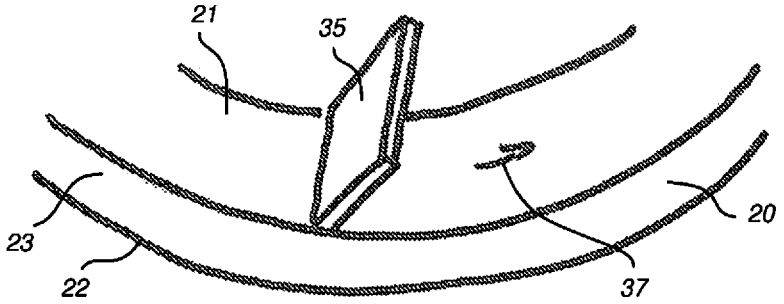
FIGS. 12A to 12G are partial perspective views of stirring devices according to other embodiments of the invention.
Figure 12B:
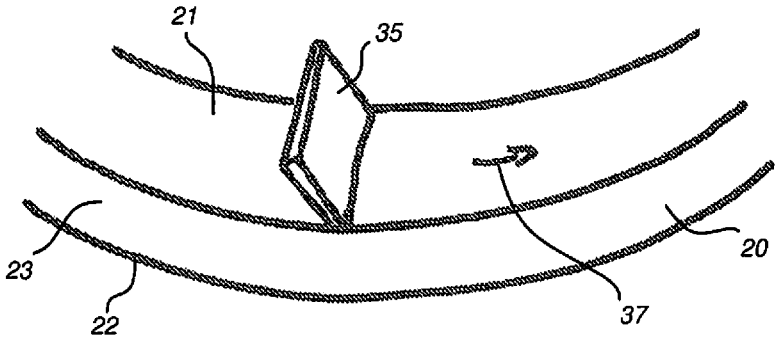

Referring to FIGS. 12A and 12B, the protective element takes the form of a planar element that is a plate 35 that is inclined relative to the annular disc body 20. In FIG. 12A, the plate 35 is inclined forward toward the direction of rotation 37 of the grinding disc 12. In FIG. 12B, the plate 35 is inclined away from the direction of rotation 37 of the grinding disc 12. It will be appreciated that the planar element could take other forms other than the plate 25, such as a vane, a blade, a fin, or any other planar element.

Figure 12C:
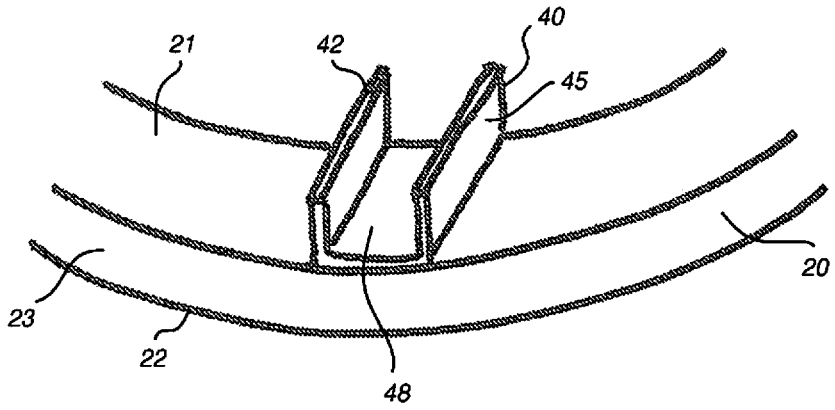
Figure 12D:
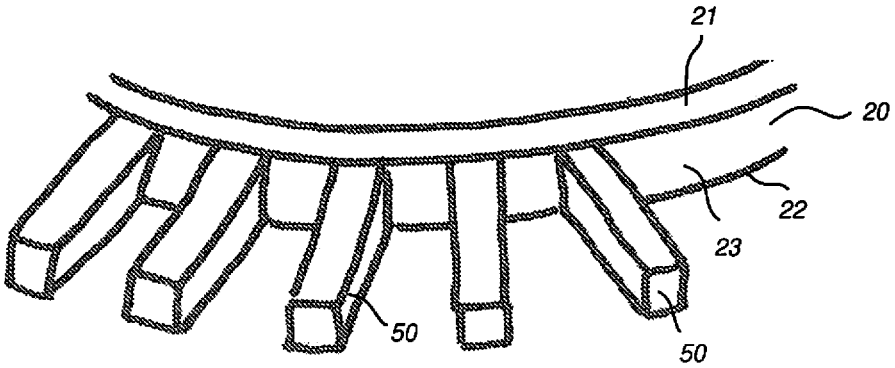

In FIG. 12C, the protective element takes the form of a channel 40 having two walls 42, 45 extending orthogonally to a base 48 mounted to the planar surface 21 of the annular disc body 20. In FIG. 12D, the protective elements take the form of rectangular posts 50 extending radially from the outer edge 23 of the annual disc body 20. In other variations of this embodiment, the posts 50 can be cylindrical (i.e. a rod), hexagonal, oval or any other polygonal shape.

Figure 12E:
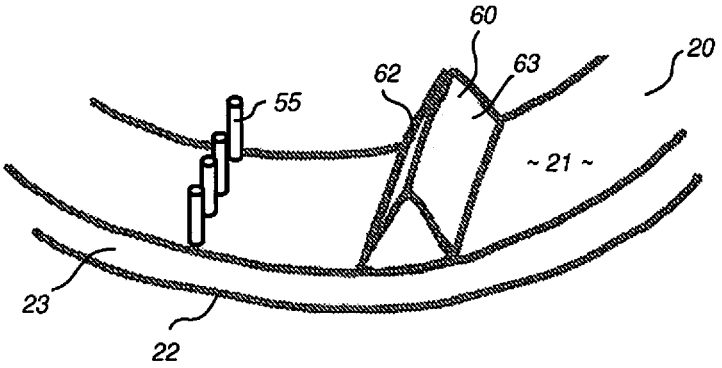

In FIG. 12E, one of the protective elements takes the form of cylindrical posts or rods 55 extending substantially orthogonally from the planar surface 21 of the annular disc body 20. In this embodiment, the rods 55 are aligned to be orthogonal to the outer edge 23. However, it will be appreciated that in other embodiments, the posts 55 need not be in alignment or be aligned but at an angle to the outer edge 23. Another of the protective elements takes the form of a ramp 60 having inclined sides 62, 63 and mounted to the planar surface 21 at its base 64.

Figure 12F:
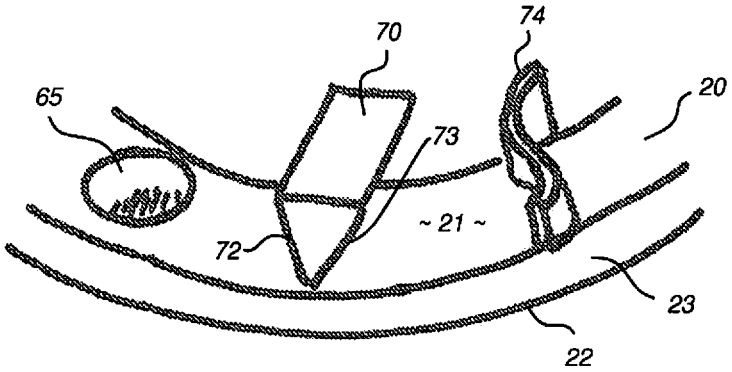
Figure 12G:
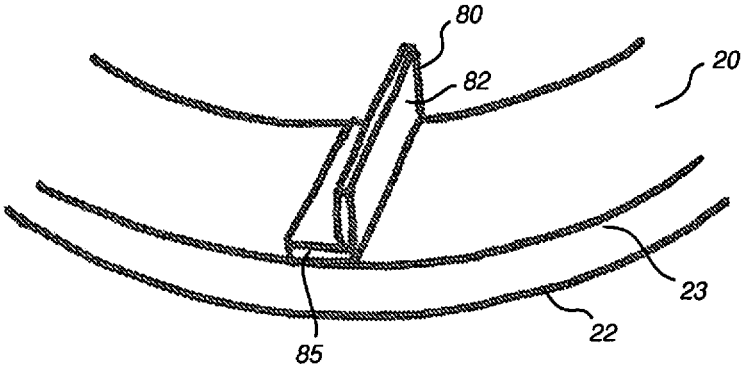

Three different embodiments of the protective elements are illustrated in FIG. 12F. One protective element takes the form of a depression or recess 65, which is concave in shape in this embodiment. In other forms, the depression or recess 65 need not be concave, but could take other shapes, such as oval, rectangular or even irregular shapes. The inventors consider that the depression 75 acts to capture or trap the grinding media M so as to promote grinding within the grinding media population, rather than causing grinding in the zone between the grinding media M and grinding discs 12. Another protective element takes the form of a an inverted triangular prism or ramp 70 having inclined sides 72, 73, both extending substantially orthogonally from the planar surface 21 of the annular disc body 20. The third protective element takes the form of a sinuous or curved planar element 74 that extends substantially orthogonally from the planar surface 21 of the annular disc body 20. FIG. 12G shows yet another embodiment of the protective element that takes the form of an angle or bracket 80 with a single wall 82 connected to a base 85 mounted to the planar surface 21 of the annular disc body.

While the protective elements illustrated in FIGS. 12A to 12C and 12E to 12G all extend from the planar surface 21, it will be appreciated that the illustrated protective elements 35, 40, 55, 60, 65, 70, 74, 75, 80 can also extend from the other planar surface 22, either in addition to or as an alternative to the protective elements extending from the planar surface 21. They may also extend radially from the outer edge 23 instead of or in addition to the planar surface 21.

Furthermore, while the protective elements 25, 40, 55, 74, 80 extend substantially orthogonally from the planar surfaces 21, 22, these protective elements can extend at an angle to the planar surfaces 21, 22 in similar fashion to the embodiment shown in FIGS. 12A and 12B. Also, the protective elements 25, 40, 55, 60, 70, 74, 80 can be mounted at an angle to the outer edge 23 instead of being tangentially at right angles as illustrated in FIGS. 9 to 11 and 12A to 12G. The radial posts 50 may also extend at an angle from the outer edge 23 instead of radially outward.

Figure 13A:
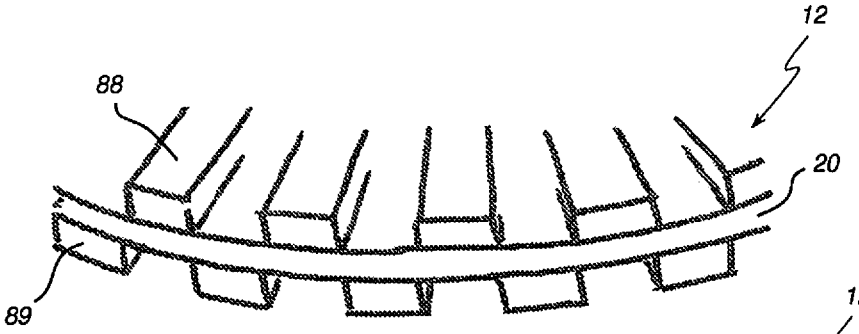
FIGS. 13A to 13E are partial perspective views of stirring devices and drive shaft assemblies according to other embodiments of the invention.

Yet further configurations for the stirring devices 12 are illustrated in FIGS. 13A to 13E. In FIG. 13A, there are blocks or rectangular prism-shaped flanges 88, 89 that extend from the opposed surfaces of the body 12. The flanges 88, 89 alternate in position so that a flange 89 extending from the lower surface 22 is between flanges 88 extending from the upper surface 21, and vice-versa.

Figure 13B:
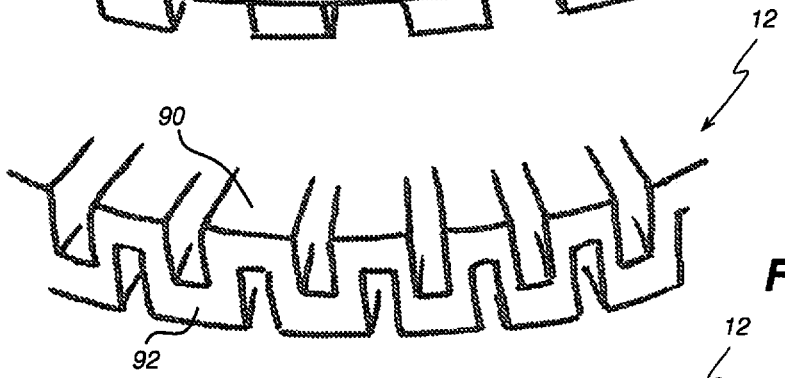

In FIG. 13B, the stirring device 12 comprises a corrugated body with upper corrugations 90 and lower corrugations 92 that form its protective elements. It will be appreciated that while the corrugations are rectangular, they may be in other forms, such as curved or triangular corrugations.

Figure 13C:
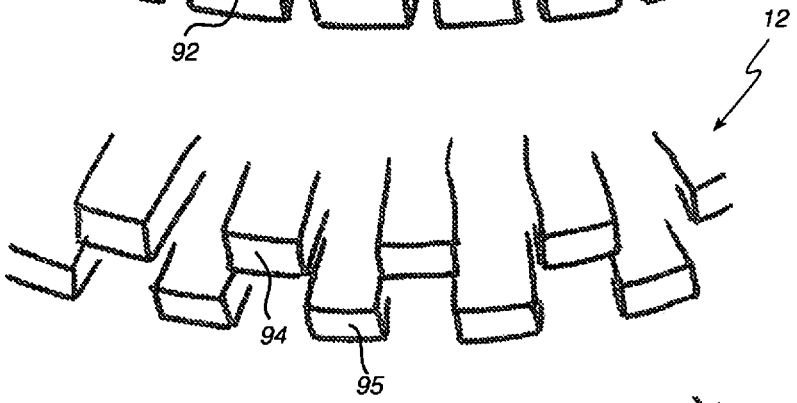

In FIG. 13C, the stirring device 12 comprises a body formed from radially extending rectangular posts or beams 94, 95 that are offset to one another, so that the beams 94 are above the beams 95. This creates protective elements from the upper beams 94 and the lower beams 95.

Figure 13D:
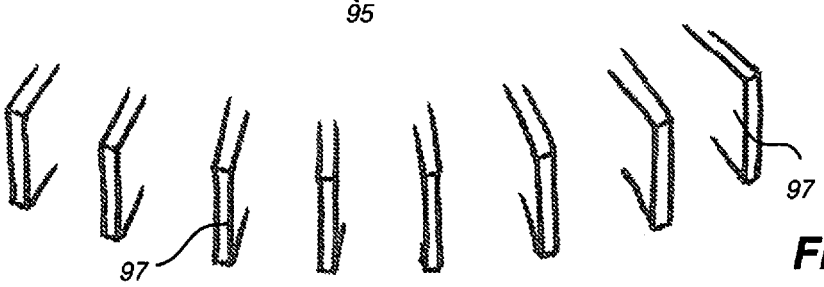

FIG. 13D illustrates an embodiment of another aspect of the invention, where the protective elements are employed directly to protect the drive shaft 11 while acting as stirring devices. A series of plates 97 project directly from the drive shaft 11 to create protective elements that deflect the slurry particles and grinding media M from the drive shaft. The plates 97 also rotate the feed slurry to promote grinding of the slurry particles by the grinding media M. In this particular embodiment, the plates 97 ensure that grinding occurs in the cavity 15, away from the surfaces of the drive shaft 11, thus minimising wear on the mill body components.

Figure 13E:
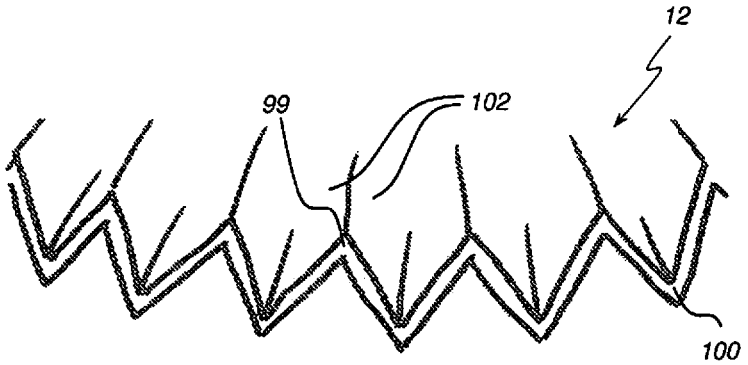

FIG. 13E shows a stirring device 12 that has a saw-tooth configuration with alternating peaks 99 and valleys 100 integrated into its body, so as to form ramp-like deflection surfaces 102 that act as the protective elements.

Figure 14:
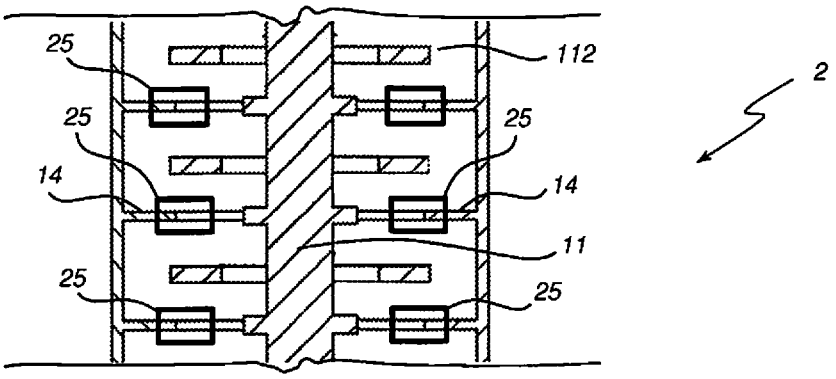
FIG. 14 is a partial cross-sectional view of a mill body according to another embodiment of the invention.

It is contemplated in a further aspect that the invention can be implemented in relation to the mill body 2 rather than the mill impeller 10. In this aspect, the invention takes an opposite configuration for the mill body 2 by providing the protective elements 25 on the shelves 14 on the inner sidewalls 13 instead of on the grinding discs 12 so as to deflect the slurry particles and grinding media M from the shelves 14 and inner sidewalls 13. This enables a zone to be created around the shelves 14 and inner sidewalls 13, minimising wear on these components of the mill body 2. In this alternative configuration, as best shown in FIG. 14, the blocks 25 are spaced apart around the annular shelf 14 in proximity to the now fully planar annular grinding discs 112 and as the annular shelves 14 are interposed between the grinding discs 12 a zone is created around the outer edges 23 of the grinding discs and part of the opposed planar surfaces 21, 22. Of course, the protective elements in this alternative configuration are not limited to the blocks 25, but can include the many variants described above, especially in relation to FIGS. 12A to 12G and 13A to 13E. This "static" configuration for the blocks 25 is sufficient to achieve the above stated technical advantages and benefits of the invention. In a further embodiment of this aspect, protective elements 25 can be provided on the inner sidewall 13 between the shelves 14 opposite the grinding discs 12 to further minimise wear. Yet another embodiment has angled annular shelves 14 instead of being orthogonal to the inner sidewall 13 that extend radially inward.

Figure 15:
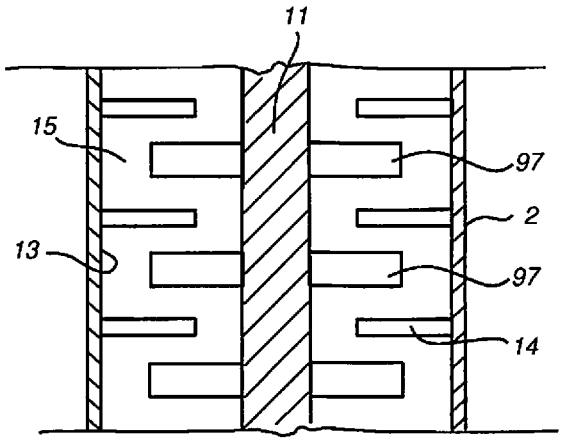
FIG. 15 is a partial cross-sectional view of a mill body according to another embodiment of the invention.

In yet another embodiment, the protective elements 25 are provided on the drive shaft 11 of the mill impeller to further enhance the zone created around the grinding discs 12. The protective elements 25 in this embodiment are axially aligned with the longitudinal axis 6 of the drive shaft 11 and may be located on annular shelves or discs similar to the mounting ring 28 and/or directly on the drive shaft. FIG. 15 shows one variation of this embodiment, using the configuration of FIG. 13D, in which the plates 97 are mounted or connected directly to the drive shaft 11. Again, it will be appreciated that the protective elements are not limited to the blocks 25, but can include the many variants described above, especially in relation to FIGS. 12A to 12G and FIGS. 13A to 13C and 13E.

While the embodiments have been described with reference to a vertically arranged mill body, the invention may also be used in other mill types, such as grinding mills having a horizontally arranged or an angled mill body. Furthermore, the invention has also been developed for use with high intensity grinding mills that are grinding fine particulates, but is also equally applicable to other grinding mills of the type that use stationary mill shells with rotating stirring elements.

It will also be appreciated that the invention is readily applicable to various types of particulate material having a variety of particle sizes and particle size distributions. Particle size is usually measured at the feed and at the discharge outlet. Hence, the particle size of the slurry at the feed inlet is typically measured as F80, meaning that 80% of the feed particles pass through a nominated screen mesh size. For example, a F80=100 μm means that 80% of all particles present will pass through a 100 μm screen aperture. An alternative measurement is F100, meaning that 100% of the feed particles pass through a nominated screen mesh size. Similarly, it will be understood by one skilled in the art that P80 means that 80% of the particles pass through a nominated screen mesh size. For example, a P80=600 μm means that 80% of all particles present will pass through a 600 μm screen aperture. The present invention has been primarily developed to process particle sizes in the range of F80=30 μm to F80=4000 μm, especially in the range of F80=80 μm to F80=200 μm for the incoming particulate material and particles sizes in the range of P80=0.1 μm to P80=1000 μm, especially in the range of P80=1 μm to P80=50 μm for the ground product. Hence, the present invention permits the grinding mill 1 to process a wide range of particle sizes for mineral particles having a wider particle size distribution in the above stated F80 and P80 ranges to produce very fine particle sizes down to P80=1 μm. Thus, the invention is readily applicable to many different types of particulate materials and is not limited to particular mineral ore types, but can include iron, quartz, copper, nickel, zinc, lead, gold, silver and platinum. Other particulate materials that can be processed using the invention include concrete, cement, recyclable materials (such as glass, ceramics, electronics and metals), food, paint pigment, abrasives and pharmaceutical substances. In these other applications, the invention is used to reduce the size of the particulate material using a grinding process.

It will further be appreciated that any of the features in the preferred embodiments of the invention can be combined together and are not necessarily applied in isolation from each other. For example, different types of protective elements can be used on the same mill impeller, such as shown in FIGS. 12F and 12G. Similarly, the protective elements 25

(or its many variants as described above and in particular with reference to FIGS. 12A to 12G and 13A to 13E) can be used on both the grinding discs 12 and the shelves 14 together, instead of being exclusive of each other. In addition, some parts of the mill body 2 only have grinding discs 12 with the protective elements 25 while other parts of the mill body 2 only have shelves 14 with the protective elements 25. This combination is also applicable to the many variants of the protective elements 25 as described above and in particular with reference to FIGS. 12A to 12G and 13A to 13E. Similar combinations of two or more features from the above described embodiments or preferred forms of the invention can be readily made by one skilled in the art. In embodiments, the protective elements 25 of the grinding discs 12 may act as a skeleton for coating with a dissimilar material that forms a sacrificial protective layer arranged to wear off and expose the protective elements within a very short period of time after the installation and start of the grinding operation. The sacrificial protective material may sometimes be used for manufacturing, shipping and installing purposes.

By providing protective elements on the stirring devices, shaft assembly or shelves of the mill body to create a zone, the invention reduces the amount of wear and thus prolongs the operational life of the components of the grinding mill, reducing maintenance time, costs and improving efficiency of the grinding mill. The zone generated by the protective elements also promotes slurry particle contact with the grinding media, also improving grinding efficiency. Thus, the grinding mill is able to operate more efficiently, consuming components such as grinding discs as at lower rate while grinding at faster rates. Moreover, the invention when implemented in a mill impeller can be readily retrofitted in existing fine grinding mills. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. A method of grinding a particulate mineral ore material, the method comprising:

stirring a mixture of said particulate mineral ore material and a grinding media by a stirring device having a body, said particulate mineral ore material having a density of at least 2,000 kg/m3, and deflecting the mixture of said particulate mineral ore material and said grinding media from the body of said stirring device by a plurality of protective elements extending outwardly from said body and being spaced apart around said body, wherein the body comprises a rotating annular grinding disc, and wherein the plurality of protective elements are elongated in a plane orthogonal to an axis of rotation of the rotating annular grinding disc and arranged at an angle to a direction of rotation of the rotating annular grinding disc to deflect the mixture of the particulate mineral ore material particles and grinding media and to promote contact between the particulate mineral ore material particles and grinding media, wherein the plurality of protective elements extend outwardly from the annular grinding disc in an axial direction of the annular grinding disc and radially outward of an outer circumferential edge of the annular grinding disc.

2. A stirring device for stirring a mixture of a particulate material and a grinding media in a grinding mill, the stirring device comprising:

a rotating annular grinding disc body, a plurality of protective elements that extend outwardly from said disc body and are spaced apart around said disc body to deflect the mixture of said particulate material and said grinding media from said disc body, wherein said particulate material are mineral ore particles having a density of at least 2,000 kg/m$^3$, and wherein the plurality of protective elements are elongated in a plane orthogonal to an axis of rotation of the disc body and arranged at an angle to a direction of rotation of said disc body to deflect the mixture of the particulate mineral ore material particles and grinding media to minimize contact of the mixture of particulate mineral ore material particles and grinding media against the disc body and to promote contact between the particulate mineral ore material particles and grinding media, wherein the plurality of protective elements extend outwardly from the disc body in an axial direction of the disc body and radially outward of an outer circumferential edge of the disc body.

3. The stirring device of claim 2, wherein said plurality of protective elements extend at an angle to a surface of said disc body.

4. The stirring device of claim 2, wherein said disc body comprises opposed surfaces and said plurality of protective elements extend from at least one of said opposed surfaces, wherein the plurality of protective elements includes a first protective element and an adjacent, second protective element, the first and second protective elements defining a circumferential gap therebetween, and wherein at least one of the opposed surfaces spans the gap and interconnects the first and second protective elements.

5. The stirring device of claim 2, wherein said plurality of protective elements each comprise at least one of a projection, an elongated body, a block-shaped element, a flange, a tooth, a planar element, a vane, a blade, a fin, a plate, a bar, a post, a rod, a channel-shaped element, a V-shaped element, a U-shaped element, a depression, a recess, a ramp-like element and a wedge-shaped element.

6. The stirring device of claim 5, wherein said plurality of protective elements comprise said block-shaped element, wherein said block-shaped element is operatively coupled to said disc body so that opposed sides of said block-shaped element extend outwardly from said opposed surfaces of said disc body and/or wherein said block-shaped element comprises an outer end that extends radially outwardly from the outer circumferential edge of said disc body.

7. Use of the stirring device of claim 2 in a stirring device assembly.

8. A stirring device assembly for a grinding mill body, comprising a plurality of stirring devices of claim 2 mounted to a drive shaft for rotating said stirring devices.

9. Use of the stirring device assembly of claim 8 as a mill impeller in a grinding mill.

10. A mill body comprising a stirring device assembly, the stirring device assembly comprising a plurality of the stirring device of claim 2 mounted to a drive shaft for rotating said plurality of stirring devices.

11. A grinding mill comprising said mill body of claim 10.

12. The grinding mill of claim 11, wherein said grinding mill is a fine grinding mill having a power consumption of 10 to 70 kWhr/t.

13. The stirring device of claim 2, wherein the plurality of protective elements includes a first protective element and an adjacent, second protective element, the first and second protective elements defining a circumferential gap therebetween, the outer circumferential edge spanning the gap and interconnecting the first and second protective elements.

14. A method of grinding a particulate material in a grinding mill of the type having a mill body and a drive shaft for rotating a plurality of annular grinding discs within said mill body, said method comprising:

introducing grinding media into said mill body;

introducing said particulate material through an inlet, wherein said particulate material are mineral ore particles having a density of at least 2,000 kg/m$^3$; and operating said drive shaft to rotate said annular grinding discs within said mill body, said annular grinding discs being mounted coaxially along said drive shaft;

wherein said rotation of said annular grinding discs induces a rotating flow of a mixture of said particulate material and said grinding media within said mill body to grind said particulate material against said grinding media to produce smaller sized mineral particles, wherein a plurality of protective elements deflect said particulate material and said grinding media away from bodies of said annular grinding discs, wherein said plurality of protective elements are spaced apart around said body of said annular grinding disc, and wherein the plurality of protective elements are elongated in a plane orthogonal to an axis of rotation of the annular grinding disc and arranged at an angle to a direction of rotation of said annular grinding disc to deflect the mixture of the particulate mineral ore material particles and grinding media to minimise contact of the mixture of particulate mineral ore material particles and grinding media against the body of the annular grinding disc, wherein the plurality of protective elements extend outwardly from the body of the annular grinding disc in an axial direction of the body of the annular grinding disc and radially outward of an outer circumferential edge of the body of the annular grinding disc.

15. A grinding element for a grinding mill, comprising:

an annular grinding disc mountable coaxially on a rotating drive shaft within a grinding mill, said annular grinding disc having opposed radial surfaces and an outermost circumferential edge, wherein the outermost circumferential edge interconnects the opposed radial surfaces, a plurality of protective elements provided along the opposed radial surfaces and along the outermost circumferential edge, wherein the protective elements protrude from said opposed radial surfaces and from said outermost circumferential edge and are spaced apart from each other in a circumferential direction along said opposed radial surfaces and along said outermost circumferential edge, and wherein the protective elements are elongated in a radial plane and arranged at an angle to a direction of rotation of said annular grinding disc to deflect a mixture of particulate mineral ore material to be grinded and grinding media from the opposed radial surfaces and from the outermost circumferential edge, to thereby minimize contact of the mixture of particulate mineral ore material to be grinded and grinding media against the opposed radial surfaces and against the outermost circumferential edge and to promote contact between the particulate mineral ore material to be grinded and grinding media, the particulate mineral ore material having a density of at least 2,000 kg/m.

16. The grinding element of claim 15, wherein each of the plurality of protective elements includes:

a first portion extending radially along and protruding upwardly from an upper-facing radial surface of the opposed radial surfaces;

a second portion extending radially along and protruding downwardly from a lower-facing radial surface of the opposed radial surfaces such that the first and second portions protrude from the annular grinding disc in opposite directions; and a third portion protruding radially outward from the outermost circumferential edge such that the third portion is positioned radially outward of the first and second portions.

17. The grinding element of claim 16, wherein the third portion is directly connected to each of the first and second portions.

18. The grinding element of claim 16, wherein a gap is defined between the third portion of a first protective element of the plurality of protective elements and the third portion of a second protective element of the plurality of protective elements that is adjacent the first protective element.

* * * * *